United States Patent [19]

Shimizu

[11] Patent Number: 4,802,687

[45] Date of Patent: Feb. 7, 1989

[54] SKI SHOE BINDING DEVICE

[75] Inventor: Satoshi Shimizu, Tokyo, Japan

[73] Assignee: Northern Commercial Limited, Tokyo, Japan

[21] Appl. No.: 172,960

[22] Filed: Mar. 23, 1988

Related U.S. Application Data

[63] Continuation of Ser. No. 943,075, Dec. 18, 1986, abandoned.

[30] Foreign Application Priority Data

Jan. 8, 1986 [JP] Japan ..... 61-000795

[51] Int. Cl.[4] ..... A63C 9/20

[52] U.S. Cl. ..... 280/615

[58] Field of Search ..... 280/615, 614

[56] References Cited

U.S. PATENT DOCUMENTS

| | | | |
|---|---|---|---|
| 2,643,888 | 6/1953 | Hargis, Jr. | 280/619 X |
| 3,603,606 | 9/1971 | Eie | 280/615 |
| 4,004,823 | 1/1977 | Pyzel et al. | 280/615 |

FOREIGN PATENT DOCUMENTS

| | | | |
|---|---|---|---|
| 572434 | 3/1933 | Fed. Rep. of Germany | 280/615 |
| 2937347A | 6/1980 | Fed. Rep. of Germany | 280/615 |
| 970912 | 6/1950 | France | 280/615 |
| 980478 | 12/1950 | France | 280/615 |
| 283869 | 1/1971 | U.S.S.R. | 280/615 |

*Primary Examiner*—David M. Mitchell
*Assistant Examiner*—Tamara L. Finlay
*Attorney, Agent, or Firm*—Nixon & Vanderhye

[57] ABSTRACT

The device comprises a toe covering portion mounted on a binding table fixed to a ski board and permitting a toe portion of a ski shoe to be inserted therein, an engaging portion always energized toward the bottom of the ski shoe and projecting from the upper surface of the ski board within the toe covering portion, a manipulating portion projecting from an upper surface of the ski board at outside of the toe covering portion and adapted to push down the engaging portion resisting the energizing force, a projection projecting from the upper surface of the ski board, an engaging recess formed in the bottom of the ski shoe for engaging the engaging portion with the ski shoe and a groove formed in the bottom of the ski shoe for engaging the projection with the ski shoe.

6 Claims, 2 Drawing Sheets

SKI SHOE BINDING DEVICE

This application is a continuation, of Ser. No. 943,075, filed Dec. 18, 1986, now abandoned.

BACKGROUND OF THE INVENTION

This invention relates to a ski shoe binding device for attaching ski shoes to ski boards.

In a conventional ski shoe binding device, after putting ski shoes on ski boards at predetermined positions, the ski shoes are attached to the ski boards by adequately manipulating the binding device.

Accordingly, when attaching, a skier is required to lean forward to manipulate the binding device for attachment.

Likewise, when detaching the ski shoes from the ski boards, the skier is required to lean forward to detach the shoes. Although the attaching and detaching manipulation is being simplified, there are still many which require troublesome manipulation.

SUMMARY OF THE INVENTION

It is therefore a general object of the present invention to provide a ski shoe binding device in which disadvantages involved in the conventional ski shoe binding devices are eliminated.

It is a specific object of the present invention to provide a ski shoe binding device in which ski shoes can be attached to ski boards simply by inserting the toe portions of the ski shoes into toe covering portions and without troublesome manipulation of the binding device.

It is another specific object of the present invention to provide a ski shoe binding device in which ski shoes can be easily detached from ski boards simply by pushing down a manipulating portion.

It is a further object of the present invention to provide a ski shoe binding device in which ski shoes will neither be detached from ski boards nor be displaced sidewardly while skiing.

In order to achieve the above objects, there is essentially provided a ski shoe binding device comprising a toe covering portion mounted on a binding table fixed to a ski board and permitting a toe portion of a ski shoe to be inserted therein; an engaging portion always energized toward the bottom of the ski shoe and projecting from the upper surface of the ski board within said toe covering portion; a manipulating portion projecting from an upper surface of the ski board at outside of said toe covering portion and adapted to push down said engaging portion resisting the energizing force; a projection projecting from the upper surface of the ski board; means for engaging said engaging portion with the ski shoe; and means for engaging said projection with the ski shoe.

BRIEF DESCRIPTION OF THE DRAWINGS

Other objects and advantages of the present invention will become apparent during the following discussion of the accompanying drawings, in which.

DETAILED DESCRIPTION OF THE EMBODIMENT

Figure 1:
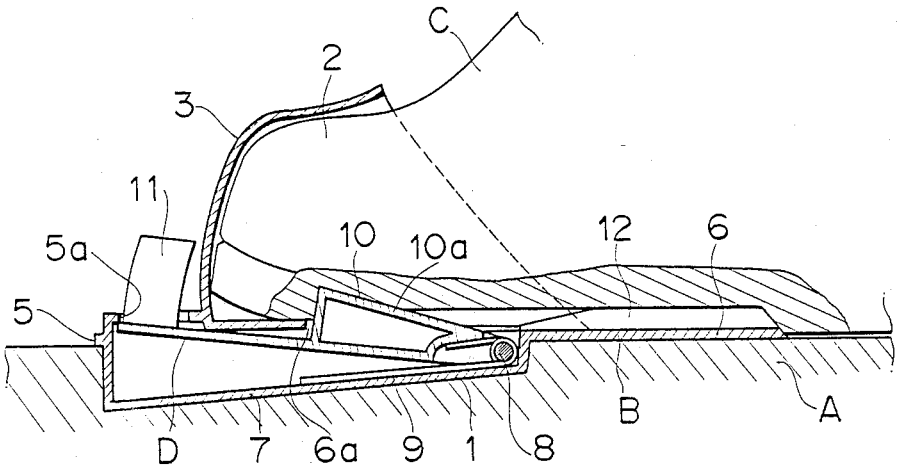
FIG. 1 is a vertical sectional view of a ski shoe binding device according to one embodiment of the present invention, wherein a ski shoe is attached to the binding device.
Figure 2:
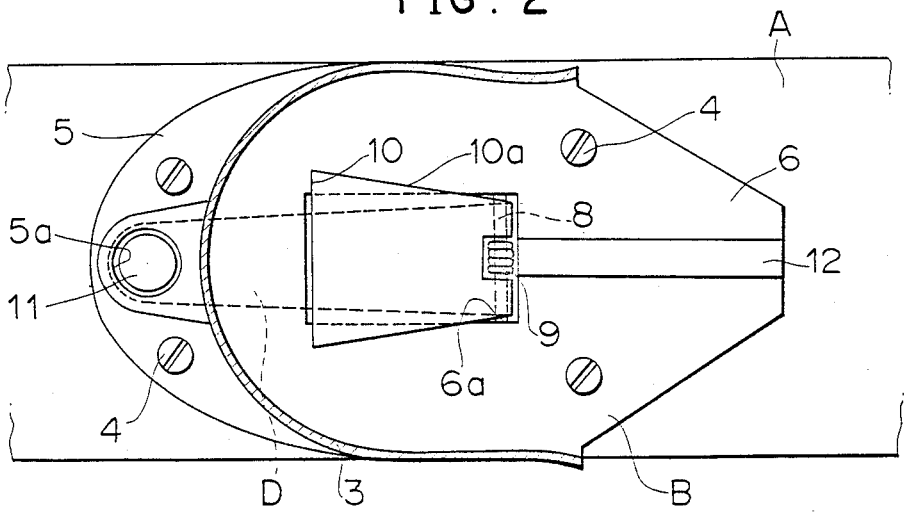
FIG. 2 is a plan view of a ski board and a binding table.
Figure 3:
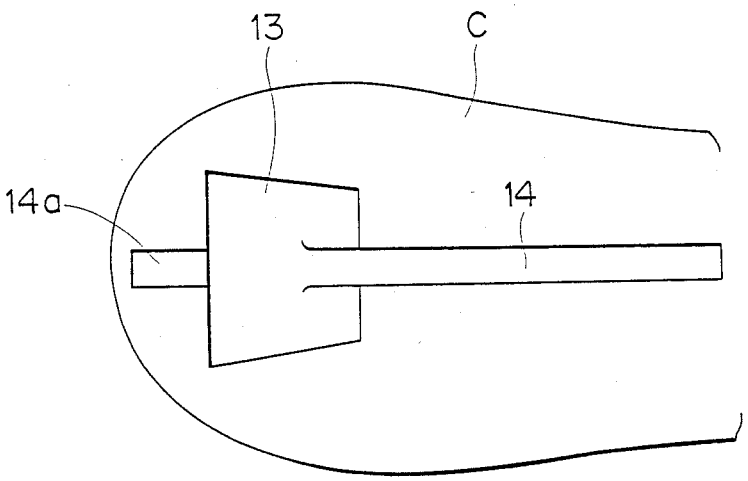
FIG. 3 is a bottom view of the ski shoe.

One preferred embodiment of the present invention will be described hereunder with reference to the accompanying drawings.

Reference character A denotes a ski board. The ski board A is formed with a recess 1 at a ski shoe attaching portion.

Reference character B denotes a binding table. The binding table B is provided with a toe covering, portion 3 into which a toe portion 2 of a ski shoe C is inserted, mounting portions 5 and 6 contacting along the upper surface of the ski board A and secured thereto by a machine screw 4, and a chamber 7 inserted into the recess 1 of the ski board A.

The chamber 7 is provided with a shaft 8 at one end portion of its heel side. The shaft 8 is pivotally attached with an inner end of an engaging piece D. Both ends of a spring 9 wound around the shaft 8 are attached under pressure to the engaging piece D and the chamber 7 respectively, thereby to energize the engaging piece D upwardly.

An engaging portion 10 permitted to penetrate a hole 6*a* of the mounting portion 6 and including an inclined surface 10*a* at the heel side projects from the engaging piece D. Similarly, a manipulating portion 11 projects from the front end penetrating a hole 5*a* of the mounting portion 5.

Further, the mounting portion 6 of the binding table B is formed with a projection 12 at a position nearer to the heel side than the chamber 7.

On the other hand, the ski shoe C is formed at its bottom with an engaging recess 13 for permitting the engaging portion 10 to engage therein and grooves 14, 14*a* for permitting the projection 12 to engage therein.

Accordingly, when the ski shoe C is progressed in such a manner as to fit the projection 12 into the grooves 14, 14*a* and to insert the toe portion 2 of the ski shoe C into the toe covering portion 3, the engaging portion 10 of the engaging piece D is pushed by the inclined surface 10*a* and once lowered.

When the toe portion 2 is completely inserted so far as the toe covering portion 3, since the engaging portion 10 and the engaging recess 13 are brought into alignment, the engaging portion 10 is inserted into the engaging recess 13 by the energizing force of the spring 9, thereby to prevent the ski shoe C from being detached from the binding table B. In this way, the attaching work of the ski shoe with the binding device is completed.

At this time, the ski shoe C is prevented from being displaced sidewardly and diagonally with respect to the ski board since the toe portion 2 is inserted into the toe covering portion 3 and the projection 12 is engaged into the recess 14.

Accordingly, the ski board A will neither be detached from the ski shoe C nor be displaced sidewardly when skiing.

Further, when the manipulating portion 11 is pushed down resisting the spring 9, the engaging portion 10 is fully entered into the mounting portion 6. Accordingly, the engagement between the engaging portion 10 and the engaging recess 13 is canceled. Thus, if the grooves 14, 14*a* are slid along the projection 12, the ski shoe C can be detached from the binding table B.

Accordingly, attaching and detaching work of the ski shoe can be easily and promptly made without using the hands and by merely manually pushing down the manipulating portion 11.

In the above embodiment, the binding table B is directly mounted to the ski board A, and the ski shoe C is formed at its bottom with grooves 14, 14*a* . Alternatively, the binding table B may be mounted to an intermediate table to reduce working process of the ski board A.

Otherwise, the engaging recess 13 and the grooves 14, 14*a* may be formed in an intermediate member conforming to the bottom of the ski shoe, so that this intermediate member can be attached to the ski shoe. In this way, the ski shoe is not required to be made specially.

As described in the foregoing, the ski shoe can be attached to the ski board through the binding without using the hands and simply by inserting the toe of the ski shoe into the toe covering portion. Accordingly, the attaching of the ski shoe can be simply and promptly made without manual operation.

And, the ski board is prevented from being detached from the ski shoe while skiing due to engagement between the engaging portion and the engaging recess, and the possible displacement of the ski board and the ski shoe can be prevented due to engagement between the projection and the grooves in association with the toe covering portion in which the toe portion is inserted.

Moreover, since the ski shoe can be detached from the ski board simply by manually pushing down the manipulating portion, the attaching and detaching work can be made extremely simply.

While particular embodiments of the present invention have been shown in the drawings and described above, it will be apparent that many changes may be made in the form and arrangement of the various component elements. In consideration thereof, it should be understood that preferred embodiments of the present invention disclosed herein are intended to be illustrative only and not intended to limit the scope of the present invention.

What is claimed is:

1. A ski shoe binding structure, comprising:

a ski board having a front and a rear and having a recess formed in an upper surface thereof, said recess having a bottom;

a toe covering member an upper toe covering portion for receiving a toe of a shoe thereunder, said toe covering member being attached to said upper surface of the ski board such that a forward end of said toe covering member is positioned at a longitudinally intermediate area of said recess, said toe covering member having a lower surface with an aperture disposed therein and below said toe covering portion;

an engaging piece having a front and a rear provided in said recess and extending longitudinally therein, said engaging piece having a longitudinal axis, said engaging piece being pivotally connected towards said rear to said ski board for rotation about an axis transverse to said longitudinal axis, said engaging piece having a detent projecting upwardly therefrom, said detent being positioned beneath said toe covering member and aligned with said aperture, said detent projecting through said aperture upon upward pivotal movement of said engaging piece, said engaging piece having a manipulating portion projecting upwardly ahead of said toe covering member;

biasing means for yieldably urging said engaging piece to rotate about said transverse axis upwardly and away from said bottom of said recess;

an elongate projection extending upwardly from the upper surface of said ski board rearwardly of said recess in said ski board;

a ski shoe having a sole thereof formed with a recess complementary to said detent;

engaging means for engaging said elongate projection longitudinally with said ski shoe;

said ski shoe and said engaging piece cooperating so that when said ski shoe is stepped onto said ski board to bring said shoe into engagement with said elongate projection by way of said engaging means and slid forwardly into said toe covering member to press down said engaging piece until said recess of said ski shoe passes said detent, said detent is locked into said recess in a snap action.

2. A ski shoe binding structure as claimed in claim 1, wherein said engaging means includes a groove formed in said sole of said ski shoe.

3. A ski shoe binding structure as claimed in claim 1, wherein said toe covering member comprises a forwardly extending portion including an aperture through which said manipulating portion projects upwardly.

4. A ski shoe binding structure as claimed in claim 3, wherein said forwardly extending portion is integrally formed with said toe covering member.

5. A ski shoe binding structure as claimed in claim 1, wherein said detent projects upwardly from a position intermediate said front and said rear of said engaging piece.

6. A ski shqe binding structure, comprising:

a ski board having a front and rear and having a recess formed in an upper surface thereof, said recess having a bottom;

a toe covering member having an upper toe covering portion for receiving a toe of a shoe thereunder, said toe covering member being attached to said upper surface of said ski board such that a forward end of said toe covering member is positioned at a longitudinally intermediate area of such recess, said toe covering member having a lower surface with an aperture disposed therein and below said toe covering portion;

an engaging piece having a front and a rear provided in said recess and extending longitudinally therein, said engaging piece having a longitudinal axis, said engaging piece being pivotally connected towards said rear to said ski board for rotation about an axis transverse to said longitudinal axis, said engaging piece having a detent projecting upwardly therefrom from a position intermediate said front and said rear of said engaging piece, said detent being positioned beneath said toe covering member and aligned with said aperture, said detent projecting through said aperture upon upward pivotal movement of said engaging piece, said engaging piece having a manipulating portion projecting upwardly ahead of said toe covering member;

a forwardly extending portion connected to said toe covering member, said forwardly extending portion including an aperture through which said manipulating portion projects upon upward movement of said engaging piece;

biasing means for yieldably urging said engagement piece to rotate about said transverse axis upwardly and away from said bottom of said recess;

an elongate projection extending upwardly from said upper surface of said ski board rearwardly of said recess in said ski board;

ski shoe having a sole thereof formed with a recess complimentary to said detent;

engaging means for engaging said elongate projection longitudinally with said ski shoe;

said ski shoe and said engaging piece cooperating so that when said ski shoe is stepped onto said ski board to bring said shoe into engagement with said elongate projection by way of said engaging means and said ski shoe is slid forwardly into said toe covering member to press down said engaging piece until said recess of said ski shoe passes said detent, said detent is locked into said recess in a snap action.

* * * * *